United States Patent [19]

Levin

[11] Patent Number: 4,601,120

[45] Date of Patent: Jul. 22, 1986

[54] FLEXIBLE ILLUMINATED DISPLAY

[76] Inventor: William J. Levin, 321 E. 13th St., Apt. 14-E, New York, N.Y. 10003

[21] Appl. No.: 669,776

[22] Filed: Nov. 9, 1984

[51] Int. Cl.[4] ..... G09F 3/00

[52] U.S. Cl. ..... 40/317; 40/550; 40/586

[58] Field of Search ..... 40/550, 317, 586, 902, 40/215, 212, 214; 362/102, 103, 108

[56] References Cited

U.S. PATENT DOCUMENTS

| | | | |
|---|---|---|---|
| 218,382 | 8/1879 | Gruyer | 40/317 |
| 2,557,383 | 6/1951 | Kerwer | 40/550 |
| 3,484,974 | 12/1969 | Culnone | 40/586 |
| 4,264,979 | 4/1981 | Gutowski | 40/902 |
| 4,308,572 | 12/1981 | Davidson et al. | 362/103 |

FOREIGN PATENT DOCUMENTS

| | | | |
|---|---|---|---|
| 2925692 | 1/1980 | Fed. Rep. of Germany | 40/550 |
| 554261 | 6/1923 | France | 40/586 |

*Primary Examiner*—Robert Peshock
*Assistant Examiner*—Cary E. Stone
*Attorney, Agent, or Firm*—Rohm & Monsanto

[57] ABSTRACT

An illuminated sign is formed on a flexible substrate and installable onto a garment or an umbrella having a deployable frame with a web member extending thereover. The illuminated sign is provided with a plurality of lamps, which may be light-emitting diodes, arranged to correspond with the shape of the symbols on the illuminated sign. The electrically interconnected lamps are electrically connectable to a battery via a switch which controls conduction of electrical energy to the lamps. Additionally, a flasher circuit may be provided for causing the lamps to flash on and off periodically. When installed on an umbrella, the switch may be located at a distance from the illuminated sign, such as on the handle thereof.

8 Claims, 2 Drawing Figures

FLEXIBLE ILLUMINATED DISPLAY

BACKGROUND OF THE INVENTION

This invention relates generally to displays, and more particularly, to a flexible display which can be illuminated and used in combination with an umbrella for signalling desired messages.

Oftentimes, when a person is out in the rain, particularly at night, the person may be beneath a dark umbrella where the person is not easily visible to others. Accordingly, a person thus obscured has difficulty in signalling to others a desired message since, in addition to being difficult to see, the person has at least one hand occupied in supporting the umbrella. There is a need, therefore, for an arrangement by which such a person can conveniently signal desired messages to others. Such messages may include the hailing of a taxi, a call for help or assistance, and an advertisement of a service or product, or simply enhancing the visibility of the person to others for sake of safety.

The need for such signalling is not necessarily limited to persons bearing umbrellas. Persons whose hands are occupied, such as with packages, or persons who desire to be more visible at night, such as runners, also have need of signalling to others.

Irrespective of whether the need for signalling results from the hands being occupied by some activity, or whether the signalling is merely precautionary, there is a need that the display which performs the signalling be flexible such that it can be conveniently stored in the pocket or folded with the umbrella of the user.

It is, therefore, an object of this invention to provide a flexible display, such as a sign, which can be folded or rolled for storage.

It is a further object of this invention to provide a sign or display which can be affixed to an umbrella for signalling a desired message to others.

It is another object of this invention to provide a sign or display which can be affixed to an umbrella in a variety of positions while the umbrella is deployed, depending upon whether the message is desired to be displayed.

It is also an object of this invention to provide a flexible display which can be folded with the web of the umbrella when the umbrella is closed without providing undue bulk.

It is additionally an object of this invention to provide a display for a message which can be seen in the dark.

Additionally, it is an object of this invention to provide a display which will draw the attention of others.

Another object of the invention is to provide a sign or display which can be installed on a flexible web of fabric material and which will conform to the contours of such fabric material.

SUMMARY OF THE INVENTION

The foregoing and other objects are achieved by this invention which provides, in a preferred embodiment, an arrangement for protecting a user from the elements while simultaneously displaying a message. In accordance with the invention, a deployable umbrella of the type having a web member attached to a deployable ribbed frame is provided with a display which is affixable thereto. The display can be affixed to the umbrella in a plurality of positions, depending on whether the display is to be visible or in storage.

In accordance with the invention, the display may be an illuminated sign comprising a plurality of light sources which are configured substantially in the shape of at least one selected symbol. Of course, a plurality of such symbols may be included in the illuminated sign, and such symbols may be alphanumeric characters. The light sources are supported substantially in the selected shape by a support which is substantially in the form of flexible substrate. The plural light sources are electrically interconnected by flexible electrical conductor.

Preferably, the various light sources are connected electrically in parallel with one another by the flexible electrical conductor. Each such light source may be an individual light-emitting diode having anode and cathode terminals. The illuminated sign is further provided with electrical terminals for receiving electrical energy. In a preferred embodiment, the electrical terminals may be configured to couple with one or more batteries.

In a highly advantageous embodiment of the invention, a periodic switching arrangement, illustratively in the form of a flasher is electrically interposed between the electrical terminals for receiving electrical energy and the plurality of light sources. The periodic switching arrangement will periodically discontinue the flow of electrical energy to the light sources, thereby producing a flashing effect which, in addition to reducing the electrical consumption of the display, also enhances its attractiveness.

In one specific embodiment which is particularly adapted for use in combination with an umbrella, a flexible web material forms a substrate on which is provided a second material which is shaped in the configuration of at least one desired symbol. A plurality of such symbols may be provided and they may be arranged as alphanumeric characters which spell a desired message. The second material is affixed to the web substrate by any known means, such as by bonding. A plurality of the light sources, which may be light-emitting diodes, are inserted through the substrate and second material such that an illuminating portion of each such light-emitting diode is visible from the side of the web on which the second material is affixed. It is preferred that the second material have a flexible characteristic such that the entire display maintains its flexibility.

In one embodiment, the light-emitting diodes are secured to the web substrate by a bonding material so that each lightemitting diode maintains its position. The electrical leads from each such light-emitting diods are then electrically coupled to one another via a flexible conductor and to a terminal for receiving the electrical energy. As described hereinabove, a periodic flasher may be interposed between the electrical terminals and the light-emitting diodes.

In a specific illustrative embodiment of the invention, the web substrate is formed of a material similar to that which forms the web of the umbrella. The second material, which is used to form the alphanumeric symbols, is preferably of a color which contrasts against the color of the web of the umbrella and the substrate. Additionally, the second material may have a highly reflected finish which improves its visibility.

The illuminated flexible display may be affixed to a garment by bonding, sewed stitching or any other affixation technique, such as hook-and-loop fasteners or snaps. In an embodiment of the invention where the subject flexible display is used in combination with an umbrella, the flexible display may be stitched to the umbrella near the outermost edge of the web, and the display can be flipped upwardly over the umbrella and secured there illustratively by hook-and-loop fasteners, or held under the umbrella when the message is not desired to be displayed.

BRIEF DESCRIPTION OF THE DRAWINGS

Comprehension of the invention is facilitated by reading the following detailed description in conjunction with the annexed drawings in which.

DETAILED DESCRIPTION

Figure 1:
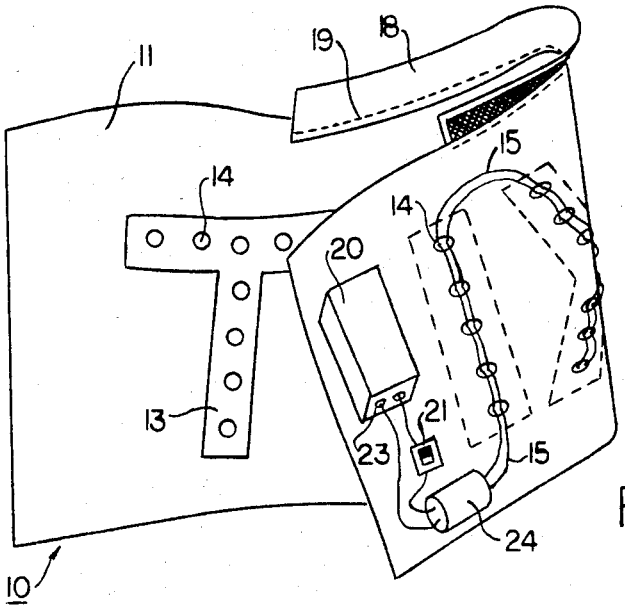
FIG. 1 is a plan view of a flexible display having illuminated lettering thereon, constructed in accordance with the principles of the invention.

FIG. 1 is a representation of a display embodiment 10 having a substrate member 11 which is generally flexible. Substrate member 11 may consist of any of many known materials and fabrics which are preferably electrically nonconductive to reduce the possibility of short-circuiting the lamp system which will be described hereinbelow.

Substrate member 11 has a first surface on which is deposited a second material 13 in the form of a symbol. In the specific illustrative embodiment of FIG. 1, second material 13 is formed in a plurality of alphanumeric characters, arranged to spell the word "TAXI". As is the case with substrate member 11, second material 13 may consist of any of a large variety of materials and fabrics. Preferably, second material 13 should have a color which contrasts markedly against the color of substrate member 11. In a highly advantageous embodiment, second material 13 has a highly reflective specular finish.

Second material 13 may be affixed to substrate member 11 by any of several known means. For example, the second material may be sewn on to the substrate member in a known manner. Alternatively, the second material may be bonded on to the material of the substrate member. An adhesive bonding between the second material and the substrate member is preferred since a somewhat more rigid union is achieved thereby facilitating installation of the illuminating lamps.

Each of the letters formed of the second material is provided with a plurality of lamps 14 which are arranged to pass through substrate member 11 and second material 13 and in an arrangement which is configured to compliment the shape of the particular letters. As shown in FIG. 1 on the reverse side of substrate 11, each of lamps 14 is coupled electrically to the other lamps by a pair of flexible electrical conductors 15. In this specific embodiment, the lamps are connected electrically in parallel to one another. In a preferred embodiment, each lamp is a light-emitting diode which provides relatively high light output for a given input of electrical energy. In embodiments where such diodes are used, the polarities of the anode and cathode terminals must be observed. Of course, the lamps may be connected in series with one another, or in any combination of parallelserial interconnection.

Electrical energy for causing lamps 14 to illuminate is obtained, in this embodiment, from a battery 20 which can be secured to the underside of substrate member 11 by any of several known affixation techniques. The flow of electrical energy from battery 20 to lamps 14 is controled by a switch 21 which is electrically interposed between a terminal 23 which is arranged to be couplable to battery 20, and the lamps. Switch 21 may be of any of several known types, including sliding, toggle, and push-button type switches.

In the specific illustrative embodiment of FIG. 1, a periodic interruption circuit 24 is electrically interposed between the battery terminals and the lamps. Periodic interruption circuit 24 is arranged to discontinue the flow of electrical energy from the battery to the lamps periodically so as to produce a flashing effect. Thus, in addition to reducing the the overall consumption of electric energy by the lamps, the resulting flashing of the lamps enhances the ability of the display to attract the attention of a person to whom the message is directed. Periodic ihterruption circuit 24 is of a known type and may be for example, an astable multivibrator circuit, of the type which is readily available. In the present embodiment, therefore, when switch 21 is closed so as to provide electrical energy to periodic interruption circuit 24, the periodic interruption circuit will provide a periodic voltage between flexible electrical conductors 15. In a practical embodiment of the invention, the voltage between flexible electrical conductors 15 has a substantially rectangular wave form.

Substrate member 11 has affixed thereto a portion of hook-and-loop fastener 18 by means of a stiching 19. The mating portion of the hook-and-loop fastener (not shown) can be affixed to any surface, device, or garment where the display is desired to be attached.

Figure 2:
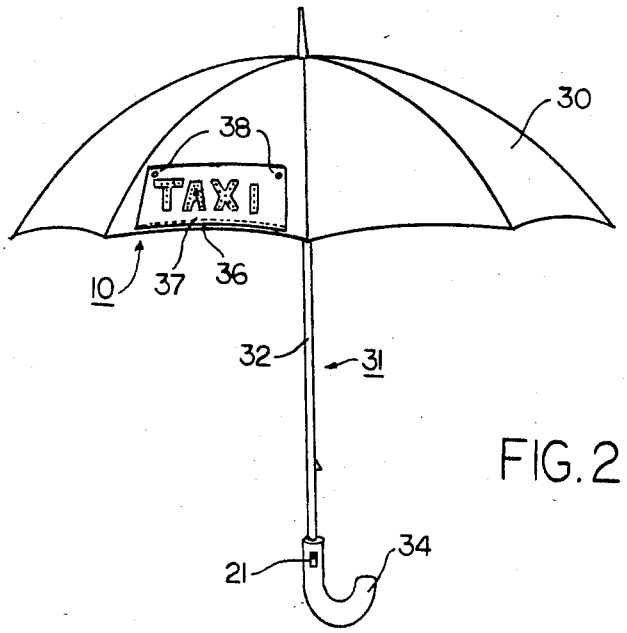
FIG. 2 is a representation of the display unit of FIG. 1 utilized in combination with an umbrella.

FIG. 2 shows display 10 installed on a web 30 of an umbrella 31. Umbrella 31 is of a conventional type wherein web 30 is arranged to extend over a deployable ribbed frame (not shown in this figure) and is attached by means of a central rod 32 to a handle 34.

In this embodiment, display 10 is affixed to web 30 by any of several known affixation techniques. For example, in the preferred illustrative embodiment, display 10 is sewn along its bottom edge 36 to the edge of web 30 by stitching 37. The upper end of display 10 is detachably coupled to web 30 by a pair of snaps 38. Snaps 38 are of a known type, and may be replaced by hook-and-loop fasteners, or any other similar affixation arrangement. When snaps 38 are released, display 10 may be swung to the underside of web 30 and affixed thereto as described herein, so that the display is not visible to others.

Display 10 is preferably provided with a backing member (not shown) which covers the circuitry and electrical interconnections on the reverse side of substrate member 11. Such a backing member may be affixed to substrate member 11 in any known manner, and may be provided with selectably openable apertures through which access may be had to the battery and circuitry. In such an embodiment switch 21 may be arranged to protrude through the backing member so as to be readily available to the user. Alternatively, if the material which forms the backing member is sufficiently thin, the region immediately over switch 21 may be marked such that the switch can be manipulated through the material. In other embodiments, however, such as the embodiment of FIG. 2, switch 21 need not be provided on or in the vicinity of substrate member 11. Instead, this switch may be arranged on handle 34 and the wiring thereto run within central rod 32. It is further to be understood that several displays may be installed on a garment or on an umbrella, the displays having respective or identical messages thereon. The messages may also be used to advertise services and products.

Although the invention has been described in terms of specific embodiments and applications, persons skilled in the art in light of this teaching can generate additional embodiments without exceeding the scope or departing from the spirit of the claimed invention. Accordingly, it is to be understood that the drawings and descriptions in this disclosure are proffered to facilitate comprehension of the invention and should not be construed to limit the scope thereof.

What is claimed is:

1. An arrangement for protecting a user from the elements while simultaneously displaying a message, the arrangement comprising:

depolyable umbrella means having a web member attached to a deployable ribbed frame, whereby when said ribbed frame is deployed, said webbed member is extended thereover;

display substrate means for supporting the message to be displayed, said display substrate means being flexible and having a plurality of apertures therethrough;

second substrate means disposed on said display substrate means and configured in the shape of at least one symbol which forms the message, said second substrate means being flexible and having a plurality of apertures therethrough, said apertures being in registration with said apertures through said display substrate means;

a plurality of illumination members arranged to enter through said apertures in registration through said display substrate means and said second substrate means, respectively, whereby said illumination members are secured therein, and visible at said second substrate means;

flexible conductor means for coupling said illumination members electrically to one another; and affixation means for joining said display substrate means to said deployable umbrella means selectably in a first position where the message on said display substrate means is to be displayed, and in a second position when the message is desired not to be displayed.

2. The arrangement of claim 1 wherein there is further provided, terminal means for receiving electrical energy for energizing said plurality of illumination members.

3. The arrangement of claim 2 wherein there is further provided switch means for controlling conduction of electrical energy to said plurality of illumination members.

4. The arrangement of claim 2 wherein said plurality of illumination members comprises a plurality of light-emitting diodes, each connected electrically to said flexible conductor means and said terminal means.

5. The arrangement of claim 4 wherein said light-emitting diodes are arranged to form shapes of alphanumeric symbols.

6. The arrangement of claim 2 wherein there is further provided periodic interruption means electrically coupled to said plurality of illumination members for periodically permitting conduction of said electrical energy to said illumination means.

7. The arrangement of claim 1 wherein sid affixation means comprises a hook-and-loop fasterner for affixing said display means to said web member.

8. The arrangement of claim 1 wherein said affixation means comprises a stitched joining of said display means to said web member.

* * * * *